US010655561B2

(12) United States Patent
Adelmann et al.

(10) Patent No.: US 10,655,561 B2
(45) Date of Patent: May 19, 2020

(54) CAST LIGHT METAL PISTON

(71) Applicant: Mahle International GmbH, Stuttgart (DE)

(72) Inventors: Jochen Adelmann, Stuttgart (DE); Ralf Braig, Schorndorf (DE); Michael Marquardt, Welzheim (DE)

(73) Assignee: Mahle International GmbH (DE)

( * ) Notice: Subject to any disclaimer, the term of this patent is extended or adjusted under 35 U.S.C. 154(b) by 334 days.

(21) Appl. No.: 14/383,226

(22) PCT Filed: Mar. 6, 2013

(86) PCT No.: PCT/EP2013/054468
§ 371 (c)(1),
(2) Date: Sep. 5, 2014

(87) PCT Pub. No.: WO2013/131937
PCT Pub. Date: Sep. 12, 2013

(65) Prior Publication Data

US 2015/0027400 A1 Jan. 29, 2015

(30) Foreign Application Priority Data

Mar. 7, 2012 (DE) ..... 10 2012 203 570

(51) Int. Cl.
*F02F 3/00* (2006.01)
*F01P 3/10* (2006.01)
(Continued)

(52) U.S. Cl.
CPC ..... *F02F 3/0084* (2013.01); *F01P 3/10* (2013.01); *F02F 3/20* (2013.01); *F02F 3/22* (2013.01); *F02F 2003/0007* (2013.01)

(58) Field of Classification Search
CPC .... F02F 3/0084; F02F 3/20; F02F 3/22; F01P 3/10
(Continued)

(56) References Cited

U.S. PATENT DOCUMENTS 6,357,341 B1 * 3/2002 Watanabe ..... F02F 3/00 123/193.6
7,900,551 B2 3/2011 Benz et al.
(Continued)

FOREIGN PATENT DOCUMENTS

DE 44 38 703 A1 5/1996
DE 102005061059 A1 6/2007
(Continued)

OTHER PUBLICATIONS

English abstract for EP-1930578.
(Continued)

*Primary Examiner* — Jacob M Amick
*Assistant Examiner* — Omar Morales
(74) *Attorney, Agent, or Firm* — Fishman Stewart PLLC

(57) ABSTRACT

A cast light metal piston for an internal combustion engine may include a piston crown and a piston skirt adjoining the piston crown. The piston skirt may include two skirt walls arranged on a pressure side and a counterpressure side, respectively. The piston skirt may have two box walls connecting the skirt walls, which conically taper towards one another in a direction of the piston crown. The piston may include an annularly encircling cooling channel. A thickness of the piston crown may amount to a maximum of 4.5 mm.

20 Claims, 2 Drawing Sheets

(51) Int. Cl.
*F02F 3/20* (2006.01)
*F02F 3/22* (2006.01)

(58) Field of Classification Search
USPC ..... 123/193.6
See application file for complete search history.

(56) References Cited

U.S. PATENT DOCUMENTS

| | | | | |
|---|---|---|---|---|
| 8,387,585 | B2 | 3/2013 | Blau et al. | |
| 2006/0118076 | A1* | 6/2006 | Schnaitmann | B22C 9/105 123/193.6 |
| 2008/0264376 | A1* | 10/2008 | Braig | F02F 3/027 123/193.6 |
| 2009/0007776 | A1* | 1/2009 | Benz | F02F 3/22 92/160 |
| 2009/0261232 | A1* | 10/2009 | Kollotzek | B22C 9/10 249/175 |
| 2010/0147250 | A1 | 6/2010 | Boczek et al. | |
| 2010/0229820 | A1* | 9/2010 | Iwata | F02F 3/00 123/193.6 |
| 2012/0037112 | A1* | 2/2012 | Muscas | F02F 3/003 123/193.6 |
| 2013/0074796 | A1 | 3/2013 | Braig et al. | |

FOREIGN PATENT DOCUMENTS

| | | | |
|---|---|---|---|
| DE | 102007020447 | A1 | 10/2008 |
| DE | 102007031581 | A1 | 1/2009 |
| DE | 102009032372 | A1 | 1/2011 |
| EP | 1930578 | A2 | 6/2008 |
| EP | 2196657 | A1 | 6/2010 |
| JP | 62085153 | | 4/1987 |
| JP | 02123260 | | 5/1990 |
| JP | H0835425 | A | 2/1996 |
| JP | 2003307153 | | 10/2003 |
| JP | 2009221900 | A | 10/2009 |
| JP | 2010525220 | A | 7/2010 |
| WO | WO-2006014741 | A2 | 2/2006 |

OTHER PUBLICATIONS

English abstract for DE-102009032379.
German Search Report for DE-102012203570.2 dated Feb. 13, 2013.
International Search Report for PCT/EP2013/054468 dated Aug. 21, 2013.
English abstract for JP-02123260.
English abstract for JP-2003307153.
English abstract for JP-62085153.
Japanese Office Action dated Jan. 31, 2017 related to corresponding Japanese Patent Application No. 2014-560348; with English Translation.
European Office Action dated Feb. 17, 2017 related to corresponding European Application No. 13 714 864.9.

* cited by examiner

CAST LIGHT METAL PISTON

CROSS-REFERENCE TO RELATED APPLICATIONS

This application claims priority to International Patent Application PCT/EP2013/054468 filed Mar. 6, 2013 and German Patent Application No. 10 2012 203 570.2 filed Mar. 7, 2012, the contents of which are hereby incorporated by reference in their entirety.

TECHNICAL FIELD

The present invention relates to a cast light metal piston, in particular an aluminium piston for an internal combustion engine with a piston crown and a piston skirt adjoining said piston crown. The invention additionally relates to an internal combustion engine equipped with such a piston.

BACKGROUND

From DE 10 2007 020 447 A1 a generic piston for an internal combustion engine is known, in which the skirt wall arranged on the pressure side is shorter in circumferential direction of the piston than the skirt wall arranged on the counterpressure side. The intention is for the effect to materialise that hardly any cracks occur in the region of the connection between the box walls and the skirt on the pressure side.

From DE 10 2009 032 379 A1 a generic piston for an internal combustion engine with a piston crown, a top land with a circumferential ring region and with a piston skirt is known, which comprises two skirt walls arranged on the pressure side and the counterpressure side and two box walls connecting these skirts walls. The skirt wall arranged on the pressure side in this case is shorter seen in circumferential direction of the piston than the skirt wall arranged on the counterpressure side. To reduce the loading of the piston, the box walls on the pressure side run linearly and obliquely, the spacing of the box walls in the region of the pin hubs being greater than in the region of the skirt wall on the pressure side.

There is a general tendency of the current engine development in the direction of a $CO_2$ reduction, which is implemented through a form of the so-called downsizing. Since in this case the oscillating mass of the pistons in internal combustion engines also plays a role, increasingly lightweight construction pistons are employed, which in addition can withstand higher thermalmechanical loads. In the case of lightweight construction pistons the main object consists in embodying the design in a load-optimised manner in order to avoid crack formations in highly loaded locations, such as for example the piston crown or the highly loaded box walls on the pressure side and simultaneously do justice to the demands for significant weight reduction and because of this a reduction of the $CO_2$ emissions. Simultaneously, such lightweight construction pistons have to have further important function characteristics, such as for example anti-seizure property, low skirt friction and smooth operation.

SUMMARY

The present invention deals with the problem of stating an improved embodiment for a lightweight construction piston of the generic type, which is characterized in particular by reduced weight and increased load capacity.

According to the invention, this problem is solved through the subject matter of the independent claim(s). Advantageous embodiments are the subject matter of the dependent claim(s).

The present invention is based on the general idea of being able to better cool and because of this construct even lighter in weight a cast light metal piston, in particular an aluminium piston, for an internal combustion engine compared with cast aluminium pistons known up to now from the prior art through an additional cooling channel in order to thereby reduce the work required for the movement of the piston. The cast light metal piston, in particular the aluminium piston, in this case comprises a piston crown facing a combustion chamber in the known manner and a piston skirt adjoining said piston crown, which has two skirt walls arranged on the pressure side and the counterpressure side for guidance and two box walls connecting these skirt walls. The box walls in this case are arranged obliquely to one another and taper conically towards one another in the direction of the piston crown. Such a light metal piston is already known for example from DE 10 2007 020 447 A1 under the name Mahle Evotec®. According to the invention, such a light metal piston now additionally and for the first time has an annularly encircling cooling channel, which makes possible effective cooling of the piston in particular in a transition region between the piston crown and an encircling ring region, wherein a thickness of the piston crown is additionally limited to a maximum of 4.5 mm Through the annularly encircling cooling channel and the reduction of the thickness of the piston crown, the cast light metal piston according to the invention can be significantly reduced with respect to its weight compared with the previously known pistons with cooling channel, wherein the piston crown reduced with respect to its thickness makes possible better heat dissipation and because of this also better cooling by means of a known spray cooling. The annularly encircling cooling channel ensures the required cooling in the ring region, which in the case of previously known light metal pistons because of the absent cooling channel was not possible in this form. Because of the obliquely positioned box walls, the required strength can be achieved without problems despite the thinner piston crown, wherein the limits of the thickness of the piston crown are usually defined by the respective casting process employed. In the following, merely the term "piston" is used as generic term for cast light metal pistons, in particular aluminium pistons.

In an advantageous further development of the solution according to the invention, the thickness of the piston crown amounts to a maximum of 3.5 mm, preferably even only 2 or 3 mm Such a thin piston crown is significantly reduced with respect to its weight compared with the piston crowns known from the prior art up to now, wherein because of the smaller thickness a spray cooling acting from below ensures quick heat dissipation and thus effective cooling of the piston crown.

Practically, the cooling channel is produced by means of a salt core. Such salt cores have already been employed for many years during the casting of light metal pistons/aluminium pistons and are therefore a tested and proven means for producing such hollow cooling channel structures. Alternatively it is obviously also conceivable that the cooling channel is produced for example by means of a sand core. Through such salt or sand cores, comparatively fine cooling channel structures can also be created, so that the cooling channel according to the invention can be individually produced for example with varying diameter.

In a further advantageous embodiment of the solution according to the invention, the two box walls run towards one another in the direction of the skirt wall on the pressure side. A pressure side and a counterpressure side is distinguished with the piston according to the invention for the reason that whenever in particular when the gas pressure that is created during the ignition in the combustion chamber acts on the piston crown, the piston is pressed aside or tilted through the obliquely positioned connecting rod with the consequence that one of the two skirt walls in its running surface is pressed against the inner wall of the cylinder bore. This skirt wall is described as skirt wall arranged on the pressure side. Through the course of the two box walls according to the invention, the risk of crack formation cannot only be reduced in the box walls but if appropriate also in the adjoining skirt walls. The skirt wall arranged on the pressure side in this case can be designed thinner in its middle region than in its edge regions assigned to the box walls, which for example can even go so far that the skirt wall arranged on the pressure side is designed by up to 50% thinner in its middle region than in its edge regions assigned to the box walls, as a result of which in turn a substantial reduction of the moved mass of the piston according to the invention can be achieved. Here it is advantageous when the increase of the thickness of the skirt wall from its middle region to its outer edge regions runs continuously, as a result of which the stress loading within the shank wall is evenly distributed.

The present invention furthermore is based on the general idea of equipping an internal combustion engine with at least one such piston and additionally providing at least two spray nozzles for the piston cooling for each light metal piston, of which one is directed at an inlet/inflow of the cooling channel of the piston and the other at the piston crown. The one spray nozzle thus conveys cooling fluid, that is engine oil, into the cooling channel where it contributes in particular to the cooling of the ring region of the light metal piston/aluminium piston. The other spray nozzle is preferentially directed at the piston crown and thus cools the same through direct spraying with oil from the bottom. Because of the small thickness of the piston crown the same can be effectively cooled since the heat that is created in the combustion chamber penetrates the piston crown comparatively rapidly and can thus be dissipated by the sprayed-on oil. Obviously it is also conceivable here that the piston crown is additionally cooled from the bottom through oil being sprayed off a rotating crankshaft, in particular provided that the crankshaft dips into an oil sump of the crankcase. All in all, an internal combustion engine with a comparatively light yet efficient piston can thus be created which requires significantly less energy for the translatoric reciprocating movement of the pistons because of their reduced weight.

Further important features and advantages of the invention are obtained from the subclaims, from the drawings and from the associated figure description with the help of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference characters relate to same or similar or functionally same components.

BRIEF DESCRIPTION OF THE DRAWINGS

There it shows, in each case schematically.

DETAILED DESCRIPTION

Figure 1:
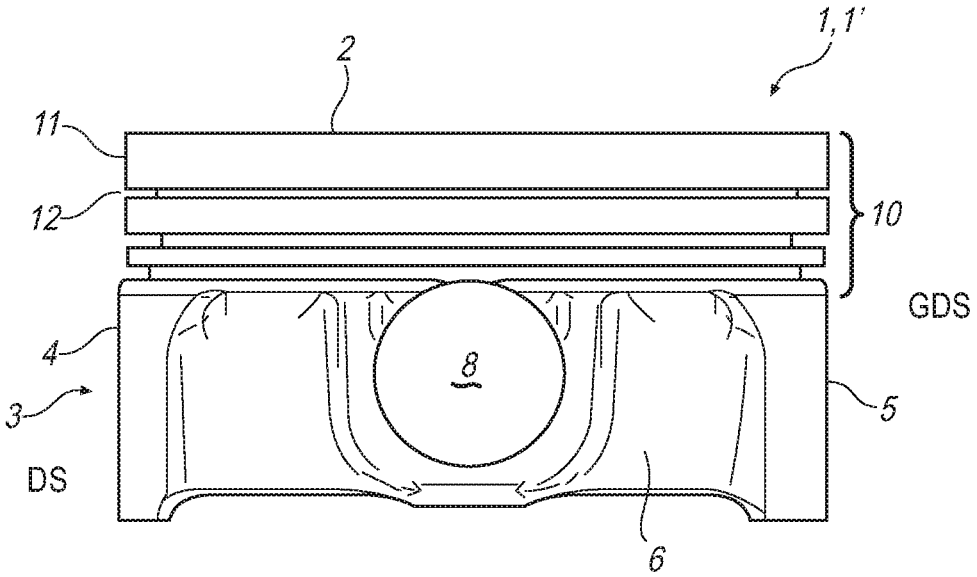
FIG. 1 a piston according to the invention in a lateral view.

According to FIGS. 1 to 4, a cast light metal piston 1 according to the invention, in particular an aluminium piston 1, 1' for an internal combustion engine 16 (see FIG. 3) comprises a piston crown 2 facing a combustion chamber 17 and a piston skirt 3 adjoining thereon. The piston skirt 3 has two skirt walls 4, 5 arranged on the pressure side DS and the counter side GDS as well as two box walls 6, 7 connecting these skirt walls 4, 5. The box walls 6, 7 in this case are conically aligned to one another in the direction of the piston crown as is clearly shown according to FIG. 4, which means that they taper towards one another from first and second ends 18, 19 and in the direction of the piston crown 2. Through this oblique position of the two box walls 6, 7 adequate strength of the light metal piston 1 can be achieved despite a reduced thickness d of the piston crown 2. In the region of the box walls 6, 7 a pin hub 8 each for connecting the piston 1 to a connecting rod which is not shown are additionally provided. According to the invention, the piston 1 now comprises an at least partly annularly encircling cooling channel 9, which according to FIGS. 3 and 4 additionally cools in particular a transition region between the piston crown 2 and a ring region 10. In the region of the ring region 10, for example an encircling top land 11 as well as various ring grooves 12 for receiving for example piston rings which are not shown are provided. As a further feature that is substantial to the invention the thickness d of the piston crown 2 amounts to a maximum of 4.5 mm. The thickness d of the piston crown 2 preferentially amounts to a maximum of 3.5 mm, preferably even a maximum of 3 mm or a maximum of 2 mm. Through the combination according to the invention according to the comparatively thin piston crown 2 with the additionally arranged cooling channel 9, a particularly light, i.e. a piston 1 that is reduced with respect to its weight can be created, which because of the lower moved mass can be operated more energy efficiently.

Figure 2:
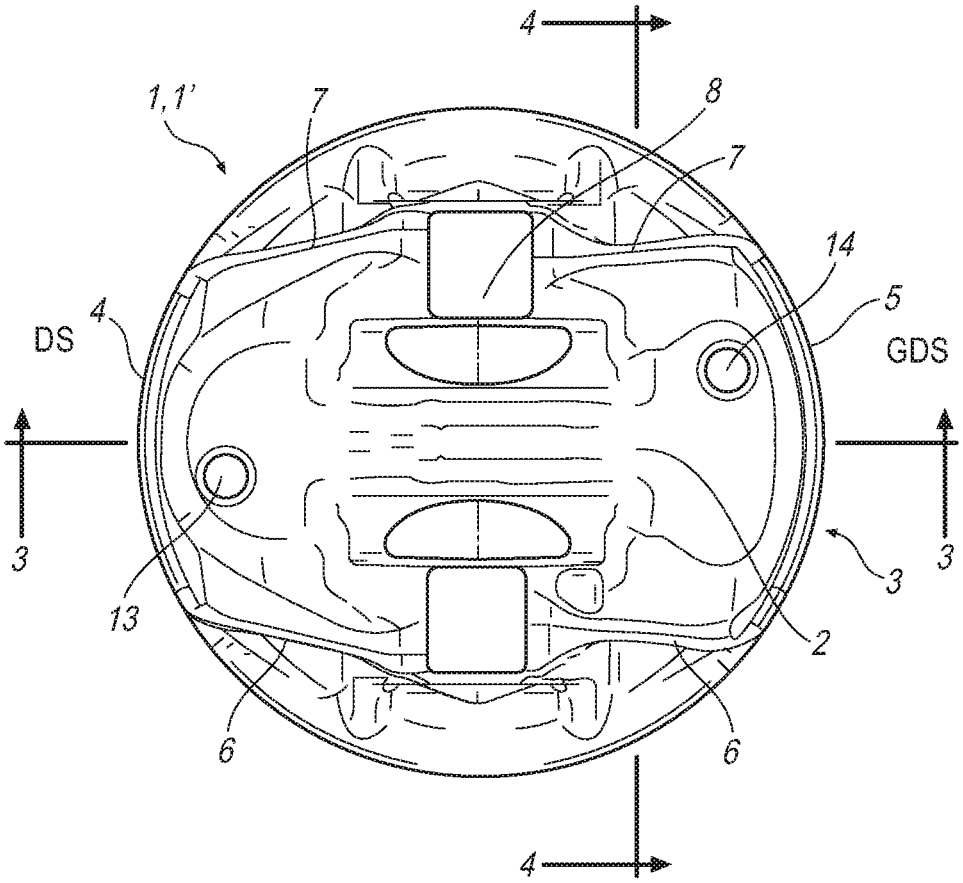
FIG. 2 a view of the piston according to the invention from below.
Figure 3:
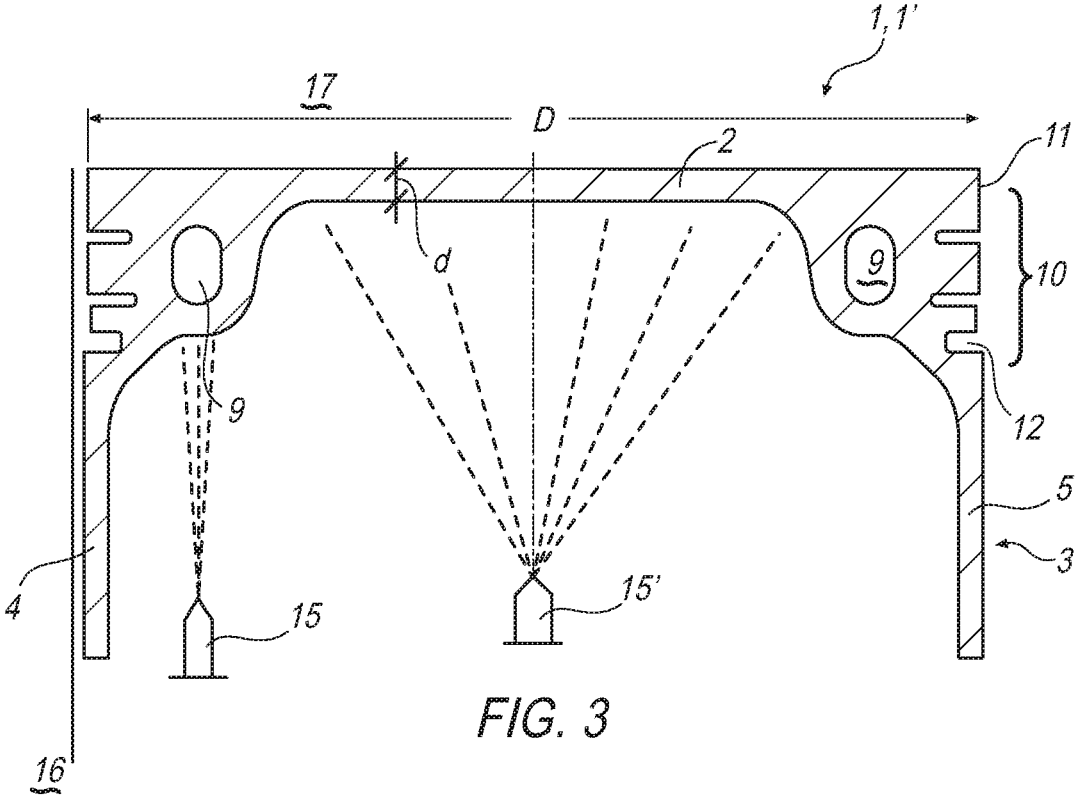
FIG. 3 a sectional representation along the section plane 3-3.
Figure 4:
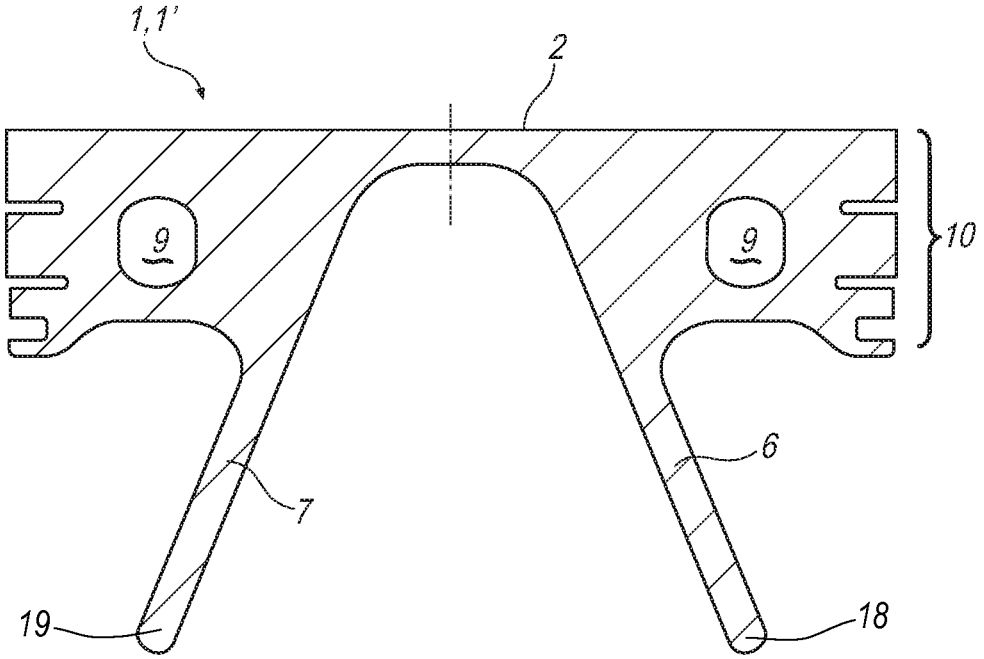
FIG. 4 a sectional representation through the piston according to the invention along the section plane 4-4.

Looking at FIG. 2 it is evident that the skirt wall 4 arranged on the pressure side DS is designed shorter in circumferential direction of the piston 1 than the skirt wall 5 arranged on the counterpressure side GDS, wherein the two box walls 6, 7 conically taper towards one another in the direction of the skirt wall 4 on the pressure side. This minimises in particular the risk of a crack formation in the region of the box walls 6, 7 and in the region of the skirt walls 4, 5. The two box walls 6, 7 in this case run in the direction of the skirt wall 5 on the counterpressure side away from one another, wherein obviously a tapering towards one another of the two box walls 6, 7 in the direction of the skirt wall 5 on the counterpressure side is also conceivable, so that in this case the two box walls 6, 7 are arranged biconvexly to one another.

The cooling channel 9 during the casting of the light metal piston 1, in particular of the aluminium piston 1' can be produced by means of a salt core or also by means of a sand core in the usual manner. In order to be able to feed cooling oil into the cooling channel 9 or to remove cooling oil from the same again, the same has an inflow 13 and an outflow 14 which are shown in FIG. 2. Here, inflow and outflow 13, 14 can obviously be also arranged the other way round. The coolant to be fed into the cooling channel 9 for the piston cooling, for example engine oil, can for example be expelled by two spray nozzles 15 and 15', wherein the spray nozzle 15 is directed for example at the inflow 13 of the cooling channel 9 whereas the spray nozzle 15' is directly directed at a bottom side of the piston crown 2, directly cooling the same because of this. Because of the minor thickness d of the piston crown 2 the heat transmitted out of the combustion chamber 17 can be dissipated comparatively rapidly and because of this the the piston 1, 1' effectively cooled. Here it is obviously additionally conceivable that a crankshaft rotating below the piston 1, 1' splashes oil onto the bottom side of the piston crown, thereby additionally cooling the same be.

In summary, the substantial features of the piston 1, 1' according to the invention can be characterized as follows: through an extremely thin piston crown 2 combined with an additionally arranged cooling channel 9 the piston 1, 1' according to the invention can be produced with greater strength despite the lower weight. The obliquely positioned box walls 6, 7 bring about the required stiffness and strength for a long lifespan of the piston crown and thus make possible low crown wall thicknesses.

The invention claimed is:

1. A cast light metal piston having a reciprocating axis for an internal combustion engine, comprising:

a piston crown and a piston skirt adjoining the piston crown, the piston skirt including:

two skirt walls arranged on a pressure side and a counterpressure side, respectively;

a first box wall connecting the skirt wall on the pressure side to the skirt wall on the counterpressure side, the first box wall having a first pin hub positioned between a pressure side portion of the first box wall and a counterpressure side portion of the first box wall;

a second box wall connecting the skirt wall on the pressure side to the skirt wall on the counterpressure side, the second box wall having a second pin hub positioned between a pressure side portion of the second box wall and a counterpressure side portion of the second box wall;

an annularly encircling cooling channel;

wherein a thickness of the piston crown amounts to a maximum of 4.5 mm;

wherein the pressure side portion of the first box wall and the pressure side portion of the second box wall conically taper toward one another in a direction toward the skirt wall arranged on the pressure side and conically taper toward one another in a direction toward the piston crown;

wherein the counterpressure side portion of the first box wall and the counterpressure side portion of the second box wall conically taper from respective first and second end portions toward one another in the direction toward the piston crown;

wherein the skirt wall arranged on the pressure side is shorter in a circumferential direction of the reciprocating axis than the skirt wall arranged on the counterpressure side; and wherein the first and second box walls are separated from one another by a distance in a radial direction of the reciprocating axis, and wherein the distance between the pressure side portion of the first box wall at the first pin hub and the pressure side portion of the second box wall at the second pin hub is greater than the distance between the counterpressure side portion of the first box wall at the first pin hub and the counterpressure side portion of the second box wall at the second pin hub.

2. The piston according to claim 1, wherein the thickness of the piston crown amounts to a maximum of 3.5 mm.

3. The piston according to claim 1, wherein the skirt wall arranged on the pressure side has a thinner thickness in a circumferentially middle region than in circumferential end regions coupled to the pressure side portions of the first and second box walls.

4. The piston according to claim 1, wherein the first and second box walls are in a biconvex arrangement.

5. The piston according to claim 1, wherein the cooling channel is formed via at least one of a salt and sand core.

6. The piston according to claim 1, wherein the piston crown and skirt are aluminum.

7. The piston according to claim 1, wherein the counterpressure side portion of the first box wall and the counterpressure side portion of the second box wall diverge away from one another in a direction of the skirt wall arranged on the counterpressure side.

8. The piston according to claim 1, wherein the pressure side portion of the first box wall and the pressure side portion of the second box wall are structured convexly to one another along a direction extending between the skirt wall on the pressure side and the reciprocating axis.

9. An internal combustion engine, comprising: a cast light metal piston having a reciprocating axis, including:

a piston crown adjoining a piston skirt, the piston skirt including a pin hub, two skirt walls arranged on a pressure side and a counterpressure side, respectively, and first and second box walls connecting the skirt walls to the pin hub, the first and second box walls conically tapering towards one another in a direction of the piston crown;

an annularly encircling cooling channel arranged in the piston crown;

wherein a thickness of the piston crown is 4.5 mm or less;

wherein each of the first and second box walls comprises a pressure side portion arranged between the pin hub and the skirt wall arranged on the pressure side and a counterpressure side portion arranged between the pin hub and the skirt wall arranged on the counterpressure side;

wherein the pressure side portions of the first and second box walls conically taper from respective first and second end portions towards one another in a direction towards the skirt wall on the pressure side; and wherein the counterpressure side portions of the first and second box walls diverge away from one another in a direction towards the skirt wall on the counterpressure side wherein the first and second box walls are separated from one another by a distance in a radial direction of the reciprocating axis, and wherein the distance between the pressure side portion of the first box wall at the first pin hub and the pressure side portion of the second box wall at the second pin hub is greater than the distance between the counterpressure side portion of the first box wall at the first pin hub and the counterpressure side portion of the second box wall at the second pin hub.

10. The internal combustion engine according to claim 9, further comprising two spray nozzles for piston cooling, wherein one spray nozzle is directed at an inflow of the cooling channel and the other spray nozzle is directed at a bottom side of the piston crown facing the piston skirt.

11. The internal combustion engine according to claim 9, wherein the thickness of the piston crown is 3.5 mm or less.

12. The internal combustion engine according to claim 9, wherein the skirt wall arranged on the pressure side is shorter in a circumferential direction of the piston than the skirt wall arranged on the counterpressure side.

13. The internal combustion engine according to claim 9, wherein the pressure side portions of the first and second box walls are structured convexly to one another along a radial direction with respect to the reciprocating axis.

14. The internal combustion engine according to claim 9, wherein a distance in a radial direction of the reciprocating axis between the counterpressure side portions of the box walls at the pin hub is less than that defined between the pressure side portions of the first and second box walls at the pin hub.

15. The internal combustion engine according to claim 9, wherein the cooling channel has a varying diameter.

16. The internal combustion engine according to claim 9, wherein the piston crown and skirt are aluminum.

17. A light metal piston for an internal combustion engine, comprising:

a piston crown having a central region defining a thickness of 4.5 mm or less;

a piston skirt coupled to the piston crown;

an annular cooling channel disposed in the piston crown;

the piston skirt including a first skirt wall arranged on a pressure side, a second skirt wall arranged on a counterpressure side, a first box wall connecting the first skirt wall to the second skirt wall, a second box wall connecting the first skirt wall to the second skirt wall and arranged at a distance from the first box wall, and a pin hub extending along a direction transverse to the first box wall and the second box wall, wherein the pressure side is separated from the counterpressure side via the pin hub;

wherein each of the first box wall and the second box wall comprises a pressure side portion arranged between the pin hub and the first skirt wall and a counterpressure side portion arranged between the pin hub and the second skirt wall;

wherein the first box wall and the second box wall taper towards one another in a direction of the piston crown, and wherein the pressure side portion of the first box wall and the pressure side portion of the second box wall conically taper from respective first and second end portions towards one another in a direction towards the first skirt wall;

wherein the counterpressure side portion of the first box wall and the counterpressure side portion of the second box wall diverge away from one another in a direction towards the second skirt wall; and wherein the first and second box walls are separated from one another by a distance in a radial direction of the reciprocating axis, and wherein the distance between the pressure side portion of the first box wall at the first pin hub and the pressure side portion of the second box wall at the second pin hub is greater than the distance between the counterpressure side portion of the first box wall at the first pin hub and the counterpressure side portion of the second box wall at the second pin hub.

18. The piston according to claim 17, wherein the pressure side portion of the first box wall and the pressure side portion of the second box wall are structured to extend convexly to one another between the first skirt wall and the pin hub.

19. The piston according to claim 17, wherein the cooling channel has a varying diameter.

20. The piston according to claim 17, wherein the first skirt wall is shorter in a circumferential direction of the piston than the second skirt wall.

* * * * *